US007918363B2

(12) United States Patent
Morabito et al.

(10) Patent No.: US 7,918,363 B2
(45) Date of Patent: Apr. 5, 2011

(54) RESEALABLE BEVERAGE CONTAINER

(76) Inventors: Weston Morabito, Glen Cove, NY (US); Terry A. Morabito, Glen Cove, NY (US)

( * ) Notice: Subject to any disclaimer, the term of this patent is extended or adjusted under 35 U.S.C. 154(b) by 540 days.

(21) Appl. No.: 11/999,554

(22) Filed: Dec. 6, 2007

(65) Prior Publication Data

US 2008/0237235 A1 Oct. 2, 2008

Related U.S. Application Data

(60) Provisional application No. 60/873,224, filed on Dec. 6, 2006.

(51) Int. Cl.
*A47G 19/00* (2006.01)

(52) U.S. Cl. ..... 220/705

(58) Field of Classification Search ..... 220/709, 220/707, 705, 373, 367.1, 304, 288, 906, 220/212.5, 212, 254.8, 254.1, 703, 694, 200, 220/378, 804, 801, 802, 803, 806, 796; 215/389, 215/388, 229, 228, 329, 316, 356, 355, 307, 215/386, 200; 222/554, 548, 562, 563, 568, 222/567, 566; D9/439, 435, 436, 434
See application file for complete search history.

(56) References Cited

U.S. PATENT DOCUMENTS 1,966,706 A * 7/1934 Brown ..... 137/398
2,943,794 A * 7/1960 Sussman ..... 239/33
2,962,185 A * 11/1960 Starr et al. ..... 220/254.8
3,009,610 A * 11/1961 Kubiliunas ..... 222/484
3,235,133 A * 2/1966 Zimmerman et al. ..... 222/478
4,408,690 A * 10/1983 Ferrero ..... 206/222
4,548,344 A * 10/1985 Hestehave et al. ..... 222/464.3
4,623,076 A * 11/1986 Karpal ..... 222/482
4,869,390 A * 9/1989 Kennedy ..... 220/709
4,966,300 A * 10/1990 Coonradt ..... 220/707
5,497,892 A * 3/1996 Takatsuki et al. ..... 215/309
5,513,762 A * 5/1996 Janani ..... 215/229
5,653,352 A * 8/1997 Kim ..... 215/228

* cited by examiner

*Primary Examiner* — Anthony Stashick
*Assistant Examiner* — Robert J Hicks
(74) *Attorney, Agent, or Firm* — Gerald T. Bodner

(57) ABSTRACT

A resealable beverage container includes a main body having a cylindrical sidewall, a bottom wall, and a lid. The lid includes an opening formed through its thickness. The main body of the container defines an interior cavity for holding a beverage. A tubular member extends from a lower surface of the lid downwardly at least partially into the interior cavity of the main body. The tubular member has open opposite axial ends, and a plurality of slots formed through its thickness axially along its length. The tubular member is aligned with the lid opening and defines a bore so that fluid may flow from the interior cavity through the bore and out the lid opening. The tubular member is interiorly threaded. A sealing cap is threadingly received by, and removable from, the bore of the tubular member to seal and unseal the lid of the beverage container.

6 Claims, 3 Drawing Sheets

RESEALABLE BEVERAGE CONTAINER

CROSS-REFERENCE TO RELATED APPLICATION

This application is related to U.S. Provisional Application Ser. No. 60/873,224, filed on Dec. 6, 2006, and entitled "Resealable Beverage Container", the disclosure of which is incorporated herein by reference and on which priority is hereby claimed.

BACKGROUND OF THE INVENTION

1. Field of the Invention

This invention generally relates to disposable beverage containers and more specifically relates to resealable disposable beverage containers.

2. Description of the Prior Art

Conventionally, beverages such as carbonated soft drinks and fruit juices as well as many other liquids requiring airtight seals, are packaged and contained in disposable beverage containers such as soda cans. These disposable beverage containers are commercially available and abundant in markets worldwide and commonly are constructed of aluminum. The conventional design may include a cylindrical can 2 with a press fitted lid 4. The press fitted lid 4 provides an air tight seal to the contained liquid. The press fitted lid 4 also may have a pivotally attached opening tab 8 and a press stamped indentation 10. To open the beverage for consumption, the tab 8 is pulled laterally from the press fitted lid 4, leading to the puncture of the press stamped indentation 10. This action breaks the air tight seal and is not reversible. Once the beverage is opened, it may not be resealed which can lead to an uncontrolled release of carbonation and an undesirable taste over a period of time. Additionally, in moving environments, the broken seal can allow liquid to exit the container at any given time leading to tarnished surfaces and materials.

OBJECTS AND SUMMARY OF THE INVENTION

It is an object of the present invention to provide a resealable beverage container.

It is another object of the present invention to provide a container for holding fluids that is resealable to minimize or prevent the inadvertent leakage of fluid from the container.

It is still another object of the present invention to provide a resealable beverage container that overcomes the inherent disadvantages of conventional beverage containers.

In accordance with one form of the present invention, a resealable beverage container includes a main body having one or more sidewalls, depending on whether the main body is generally cylindrical, cubical, polygonal or the like in shape, and a bottom wall joined to a first axial end of the main body. The main body defines an interior cavity for holding a fluid, such as a beverage, although it is envisioned to be within the scope of the present invention that other fluids, such as water, paint, motor oil and the like, may be held thereby.

The main body has an open second axial end on which is non-removably mounted, and joined thereto, a lid, so as to create with the main body a fluid tight seal. The seal is preferably airtight and strong enough to prevent leakage of the contents of the container, even if the contents are pressurized to some extent, in a manner similar to conventional beverage containers, such as aluminum or plastic beverage containers as shown in FIG. 1 and described previously. The lid includes an opening formed through the thickness thereof, which is preferably positioned off-center from the lid and nearer a sidewall of the main body of the container.

Mounted on the lower surface of the lid and at least partially extending axially downwardly therefrom into the interior of the main body is a tubular member, preferably cylindrical in form. The tubular member (also referred to herein as a "cap receiving tube") has a lower open axial end and an opposite upper open axial end where the tubular member is joined to the lid, and defines a bore extending axially between the lower end and the upper end. The open upper axial end of the tubular member is aligned with the opening formed through the thickness of the lid to allow the egress of fluid held within the interior cavity of the main body therethrough. The open lower end and the open upper end, and the bore, of the tubular member, together define a channel for the passage of the fluid content of the main body to pass through and out of the lid opening when the main body is preferably tilted for pouring the fluid therefrom. Preferably, the main body of the container, the bottom end and the lid, as well as the tubular member, is formed from aluminum or plastic, but may be formed from other materials as well.

The tubular member has a sidewall or sidewalls and may further include a plurality of spaced apart openings or slots formed through the thickness of the sidewall or sidewalls, along the axial length and periodically about the circumference thereof. The openings or slots are provided to ensure that most if not all of the fluid contents of the main body may pass through the tubular member and into the bore for egress from the container when the volume of the fluid remaining in the main body is diminished to such a point that the fluid no longer reaches the position of the lower open axial end of the tubular member to pass therethrough when the container is angled from the vertical or is positioned upside down by the consumer when pouring the contents therefrom or consuming the contents of the container. Therefore, any remaining small volume of fluid in the main body of the container will not become trapped therein, as it will pass through the openings or slots formed in the tubular member and out the top open axial end of the tubular member and the opening in the lid of the container.

The tubular member includes an outer wall and an inner wall situated opposite the outer wall, the inner wall defining the bore of the tubular member. Preferably, the inner wall is threaded at least partially axially along the length of the tubular member.

The beverage container of the present invention further includes a removeable sealing cap. The sealing cap has an upper end and a lower end situated axially opposite the upper end, and defining an axially extending main body between the upper end and lower end. The upper end preferably includes a flange which extends radially outwardly from the upper end, the outer diameter of the flange being preferably greater than the outer diameter of the main body of the sealing cap. An O-ring or other sealing structure may be included, and is preferably fit onto and about the circumference of the main body of the sealing cap. As will be seen, the O-ring helps ensure a fluidtight seal when the main body of the sealing cap is received by the tubular member of the main body of the container, and is pressed between the underside of the larger diameter flange of the sealing cap and the upper (outer) surface of the lid when the sealing cap is mounted on the main body of the container.

The main body of the sealing cap includes an exterior surface which is preferably threaded in a manner compatible to the threaded inner surface of the tubular member of the main body of the container so that the sealing cap may be screwed on and off the container main body, with the main body of the sealing cap being threadingly received at least partially by the bore of the tubular member to form a preferably liquidtight seal therewith, and to sealingly cover any openings or slots formed through the thickness of the tubular member with which it comes in contact. The sealing member may be similarly formed from an aluminum or plastic material, but it is envisioned to form the sealing cap at least partially from other materials as well, such as rubber, especially the outer surface of the main body of the sealing cap which threadingly engages the inner surface of the tubular member and seals the openings or slots with which it come in contact.

The resealable beverage container of the present invention may further include a locking mechanism to ensure that the sealing cap lockingly engages the tubular member of the main body of the container. A detent (or protrusion) may be situated on the outer surface of the main body of the sealing cap near the lower end thereof, and similarly, a complementary shaped protrusion (or detent) may be situated on the inner surface of the tubular member, preferably near the lower axial end thereof, or at a distance axially from the upper axial end of the tubular member which is approximately equal to the axial length of the main body of the sealing cap so that, when the sealing cap is fully seated on the container main body, with the flange resting tightly on the lid with the O-ring situated therebetween, the protrusion of one of the tubular member and the sealing cap is selectively received by the detent of the other of the tubular member and the sealing cap. The resistance provided between the engagement of the sealing cap and the tubular member of the main body of the container when the protrusion is received by the detent may be felt by the user who is screwing the cap onto the container lid so that he or she knows the cap is fully secured to the main body of the container in a leakproof manner, or the engagement of the protrusion and the detent may be heard by the user for the same purpose, and to further securely lock the cap to the main body. This resistance may be overcome with additional, but preferably slight, force to remove the protrusion from the detent when the user wishes to unscrew the sealing cap from the main body of the container.

The sealing cap may further include a tab, protrusion or pivotable u-shaped member extending from the top surface of the upper end of the sealing cap and acts as a handle for the user to grasp so that he or she may screw or unscrew the sealing cap onto or from the main body of the container.

These and other objects, features and advantages of the present invention will be apparent from the following detailed description of illustrative embodiments thereof, which is to be read in connection with the accompanying drawings.

DETAILED DESCRIPTION OF PREFERRED EMBODIMENTS

Figure 1:
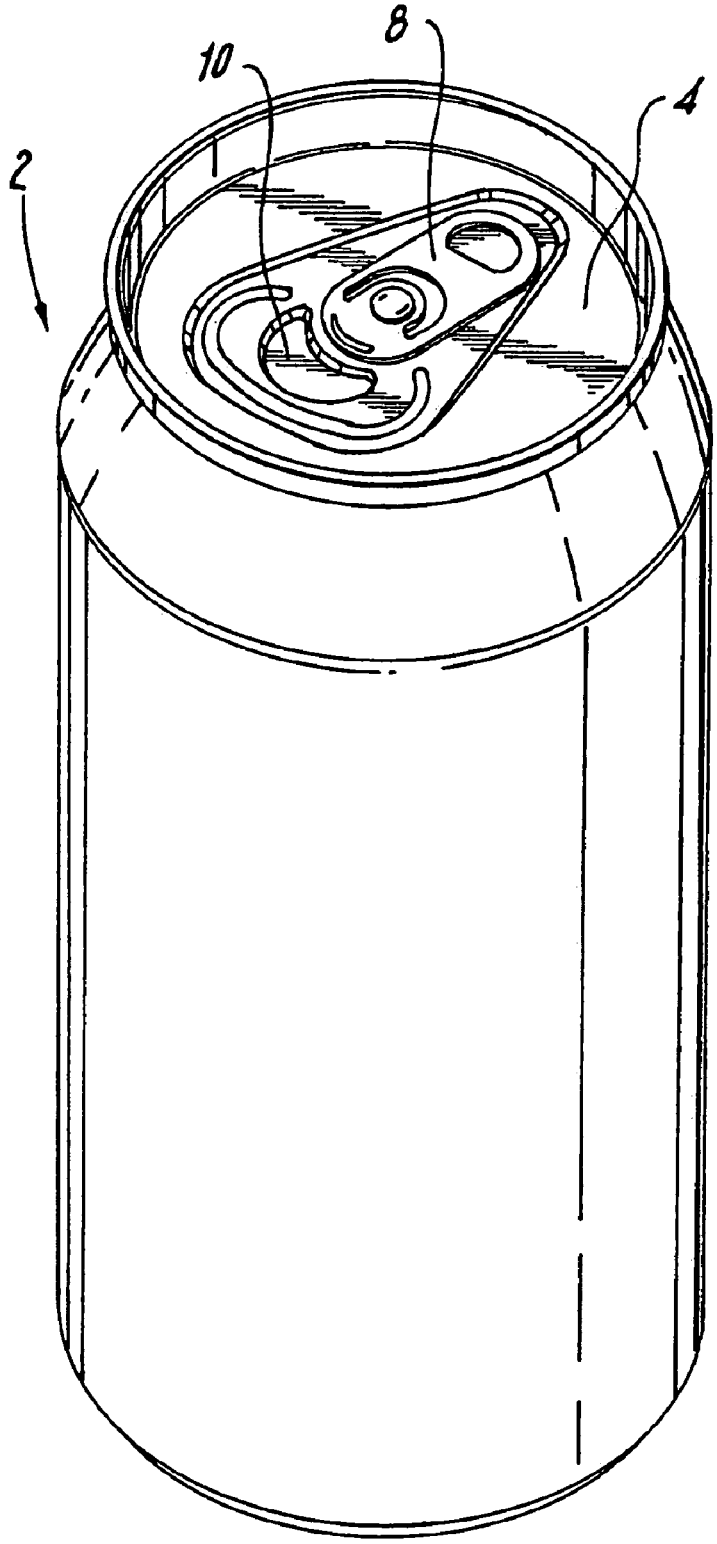
Fig. 1 (Prior Art)
FIG. 1 is a top view of the conventional design of a beverage container.
Figure 2:
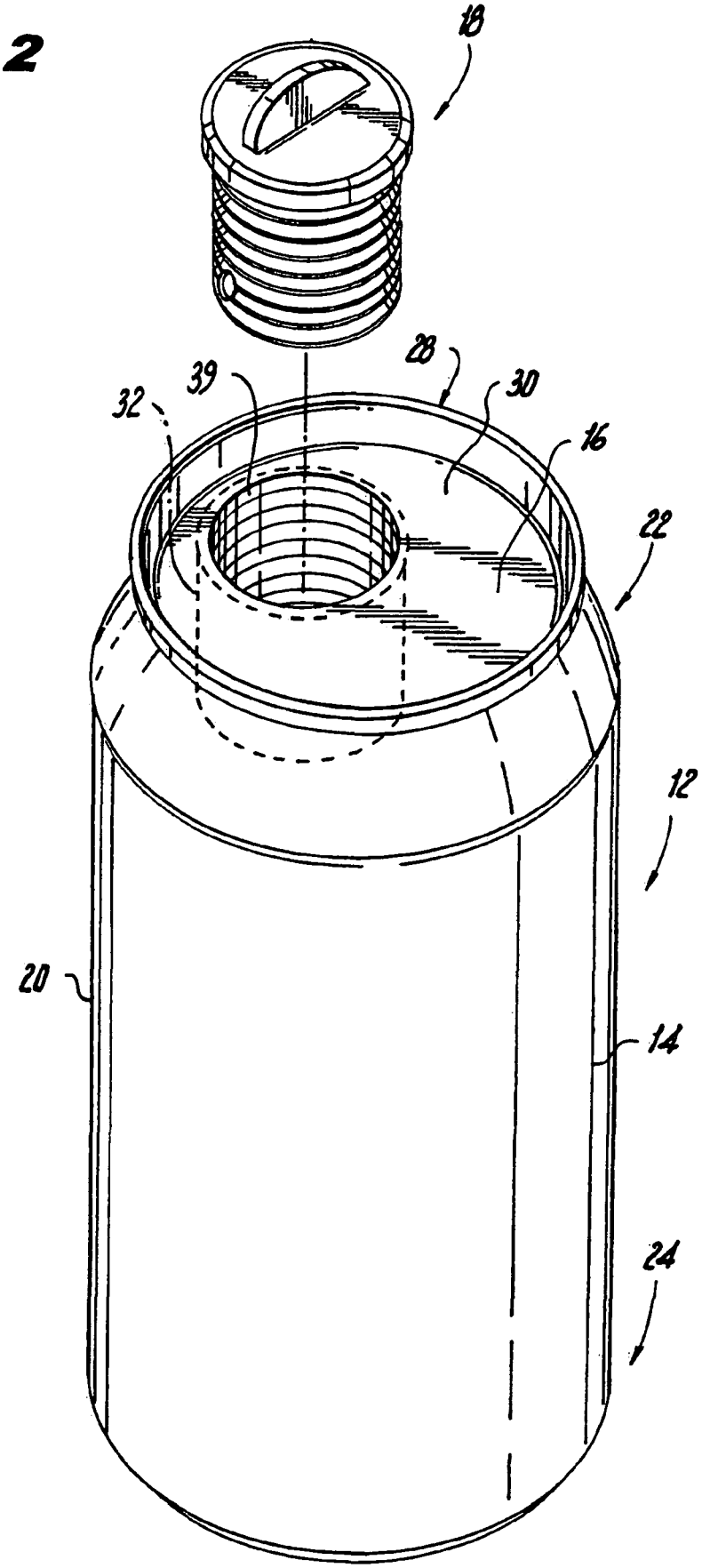
FIG. 2 is a partially exploded, perspective view of a beverage container formed in accordance with the present invention.
Figure 3:
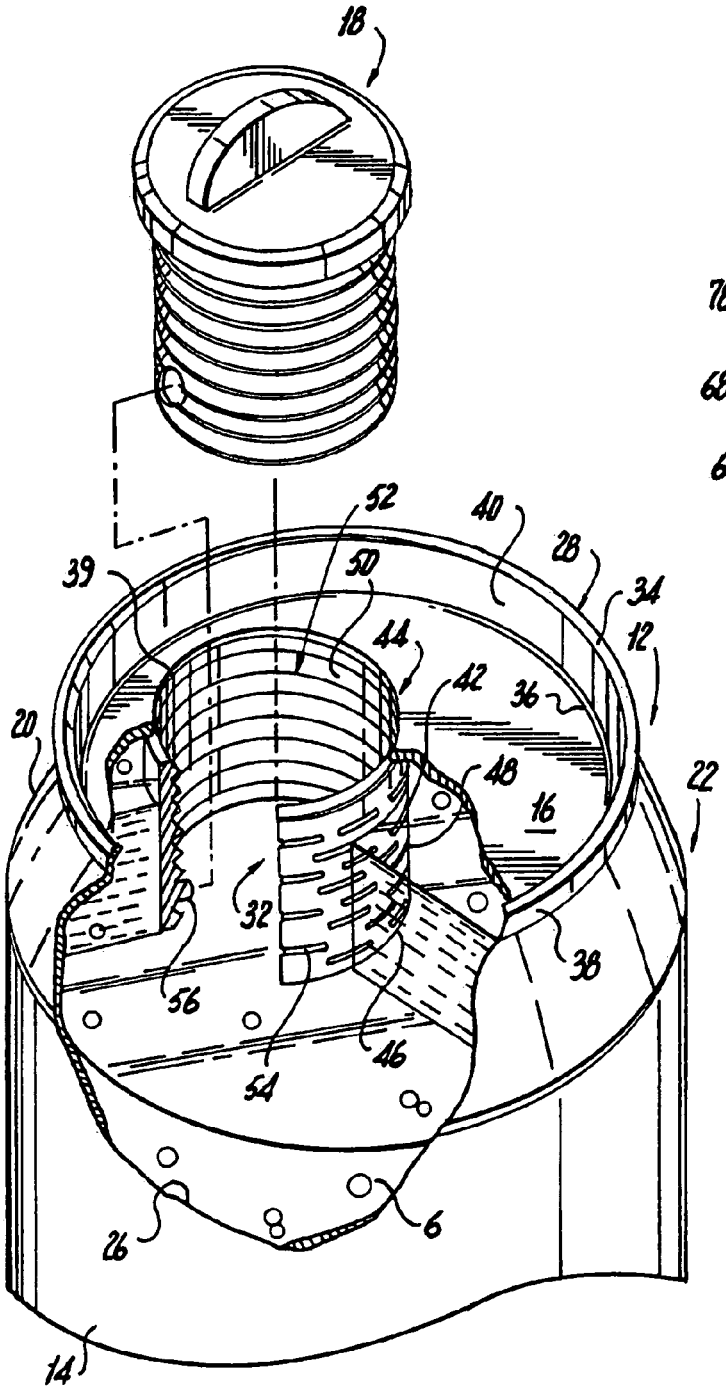
FIG. 3 is a partially exploded, partial view of the beverage container of the present invention shown in FIG. 2, with the sidewall and lid thereof partially broken away.

As shown in FIGS. 2-3, the present invention relates to a resealable beverage container 12. The container 12 may be disposable or reusable. The beverage container contains a main body 14, lid 16 and sealing cap 18.

The main body 14 of the present invention includes a sidewall 20, upper end 22, lower end 24 and a central cavity 26. The main body 14 and lid 16 may be constructed from a variety of materials, but preferably is constructed with sheet aluminum. The lower end 24 of the main body 14 is closed and the upper end 22 is open. A lid 16 is press fitted over the upper end 22 of the main body 14 to create an airtight seal.

The lid 16 of the present invention includes an outer rim 28, main surface 30, and cap receiving tube 32. The lid 16 may be a variety of shapes but is preferably circular, conforming to the shape of the upper end 22 of the main body 14. The outer rim 28 has an upper surface 34, lower surface 36, outer surface 38 and inner surface 40. The main surface 30 of the lid 16 is attached to the inner surface 40 of the outer rim 28 medially between the upper surface 34 and lower surface 36. The lid 16 is then attached over the upper end 22 of the main body 14 with its outer surface 38 aligned with the main body sidewall 20. The lid includes an opening 39 formed through the thickness thereof, which opening 39 is preferably positioned off-center from the lid and close to the outer rim 28 thereof.

The cap receiving tube 32 is preferably a cylindrical tube having a main body 42, upper end 44, bottom end 46, outer surface 48, inner surface 50 and internal bore 52. The upper end 44 and bottom end 46 are open. The cap receiving tube 32 is joined to the lower surface of the lid 16 and is situated thereon such that the open upper end 44 is in alignment and fluid communication with the lid opening 39.

Preferably, the inner surface 50 of the receiving tube 32 is threaded. The main body 42 may include a plurality of openings or slots 54 cut through the inner surface 50 and outer surface 48. The inner surface 50 also has a convex extrusion or protrusion 56 situated near the bottom end 46 that is part of a snap-lock mechanism. The receiving tube 32 can be a variety of dimensions but is preferably about 1⅜ inches in length and about ⅞ inches in diameter.

Figure 4:
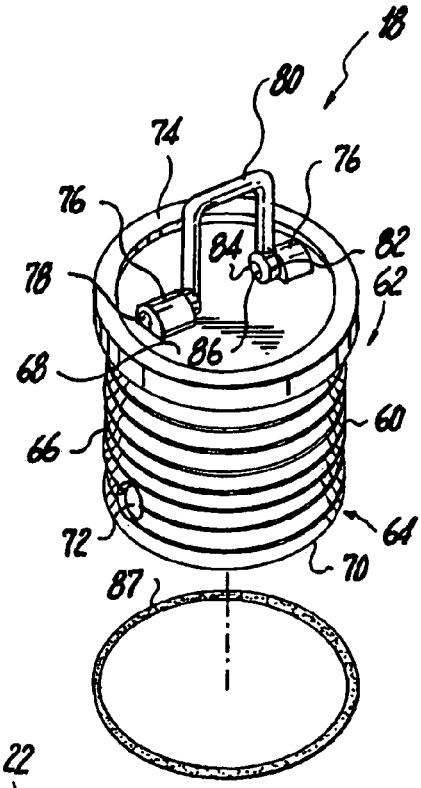
FIG. 4 is a partially exploded, perspective view of a sealing portion of the beverage container formed in accordance with a first embodiment of the present invention.

As shown in FIG. 4, the sealing cap 18 of the present invention includes a main body 60, upper end 62, lower end 64, outer surface 66, top surface 68, and bottom surface 70. The upper end 62 and lower end 64 are each closed by the top surface 68 and bottom surface 70, respectively. The outer surface 66 is threaded and has a concave extrusion or detent 72 situated near the bottom surface that is part of the snap-lock mechanism. Of course, it should be understood that the positions of the concave extrusion or detent 72 and the convex extrusion or protrusion 56 may be reversed to form the snap-lock mechanism, with the concave extrusion or detent 72 being formed on the cap receiving tube 32 and the convex extrusion or protrusion 56 being formed on the sealing cap 18.

The upper end 62 of the sealing cap 18 has a radially extending flange 74. The top surface 68 may include a plurality, but preferably two, extrusions 76, each with a horizontal bore 78. A hemispherical or U-shaped tab 80 has two ends 82, each end having a horizontal bore 84 that is aligned with the horizontal bores 78 of the extrusions 76. Securing rods 86 are pushed through the bores 84 of the tab 80 and bores 78 of the extrusions, pivotally attaching the tab 80 to the top surface 68. The sealing cap 18 can be formed with a variety of dimensions but is preferably about 1 5/16 inches in length and about ⅞ inch in diameter, and fits within the receiving bore 52 of the cap receiving tube 32. An O-ring 87 is fitted over the main body 60 against the underside of flange 74 to act as a sealing member.

Figure 5:
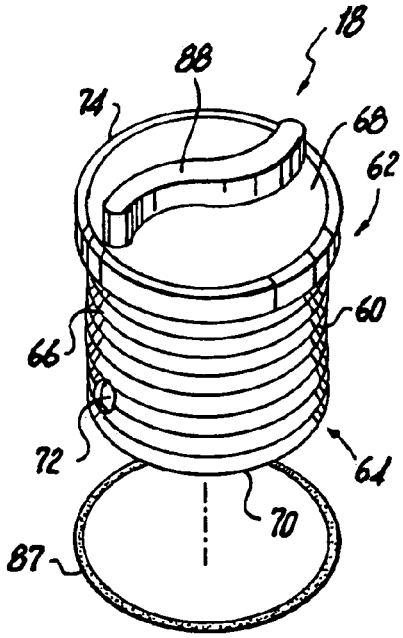
FIG. 5 is a partially exploded, perspective view of a sealing portion of the beverage container formed in accordance with second embodiment of the present invention.

In a second embodiment of the present invention, as shown in FIG. 5, the top surface 68 of the sealing cap 18 may include a low profile tab 88 that can have a variety of shapes, but is preferably S-shaped. The S-shaped tab 88 may be fixed to the top surface 68 of the cap 18 and extend outwardly therefrom in place of the hemispherical or U-shaped pivotal tab 80 of the first embodiment.

Filling of the beverage container 12 of the present invention can either be large scale at a location such as a processing plant or individually such as at home. The liquid 6 is added to the central cavity 26 of the container 12 and the sealing cap 18 is threaded into the receiving bore 52 of the cap receiving tube 32. The hemispherical tab 80 or low profile tab 88 can be rotated by the user's fingers to thread the sealing cap 18 into the receiving bore 52. The snap-lock mechanism alerts the user as to when an airtight and liquidtight seal has most certainly been achieved. As the sealing cap 18 is threaded into the receiver bore 52, the convex extrusion or protrusion 56 and concave extrusion or detent 72 will come in contact with each other, indicating that the O-ring 87 is tight against the main surface 30 of the lid 16 and that the cap 18 is fully seated on the main body 14 of the container 12. The user will feel a snap or hear a click when the snap-lock mechanism engages.

When the beverage container 12 is ready to be opened, the user rotates the hemispherical tab 80 or low profile tab 88 on the top surface 68 of the sealing cap 18, disengaging the snap-lock mechanism and unthreading the sealing cap 18 from the receiving bore 52 of the cap receiving tube 32. Once the cap 18 is removed, the user may pour liquid 6 from the beverage container 12, which liquid may flow through the open bottom end 46 or slots 54 into the internal bore 52 of the cap receiving tube 32, and out the container 12. If the user wishes to preserve the unused remaining liquid, the sealing cap 18 is threaded back into the receiving bore 52 until the snap-lock mechanism is engaged.

The present invention addresses the problems associated with the conventional design by allowing the container to be resealed to preserve the beverage, minimize de-carbonation of the beverage and prevent leakage, as well as allowing the container be reused. Also, although a resealable beverage container is particularly described herein, it should be realized that the invention encompasses and is applicable to all types of containers holding a fluid, for example, motor oil, where there is a need or desire to reseal the container.

Although illustrative embodiments of the present invention have been described herein with reference to the accompanying drawings, it is to be understood that the invention is not limited to those precise embodiments, and that various other changes and modifications may be effected therein by one skilled in the art without departing from the scope or spirit of the invention.

What is claimed is:

1. A resealable fluid container, which comprises:

a main body having an upper end and a lower end situated opposite the upper end, at least one sidewall extending between the upper end and the lower end, and a bottom wall joined to at least one sidewall at the lower end of the main body, the main body defining an interior cavity for holding a fluid;

a lid joined to the main body at the upper end thereof and creating a fluid tight seal with the main body, the lid having an opening formed through the thickness thereof, the lid having an upper surface and a lower surface situated opposite the upper surface;

a tubular member, the tubular member having a lower open end and an upper open end situated axially opposite the lower open end, and defining a bore extending axially between the lower end and the upper end and in fluid communication with the lower open end and the upper open end of the tubular member, the tubular member being joined to the lid and extending outwardly from the lower surface thereof at least partially into the interior cavity defined by the main body of the container, with the upper open end of the tubular member being aligned and in fluid communication with the opening formed in the lid, the tubular member having an outer surface and an inner surface situated radially inwardly of the outer surface, the inner surface of the tubular surface being helically threaded;

a sealing cap, the sealing cap having an upper end and a lower end situated axially opposite the upper end, and defining a main body extending axially between the upper end and lower end, the main body having an outer surface, the outer surface being helically threaded, the main body of the sealing cap being dimensioned with respect to the tubular member so as to be threadingly receivable by and at least partially within the bore of the tubular member to form a fluid tight seal therewith, the sealing cap being threadingly removeable from the bore of the tubular member to allow fluid contents contained in the interior cavity of the main body to pass through the bore of the tubular member and the opening of the lid.

2. A resealable fluid container as defined by claim 1, wherein the tubular member includes a plurality of openings formed through the thickness thereof along at least a portion of the axial length thereof, the openings being in fluid communication with the bore of the tubular member to allow the fluid contents of the main body to selectively pass therethrough and into the bore of the tubular member.

3. A resealable fluid container as defined by claim 1, wherein the sealing cap includes a top surface, and a handle structure extending outwardly from the top surface thereof for grasping by the user of the container to threadingly secure and threadingly remove the sealing cap to and from the tubular member.

4. A resealable fluid container as defined by claim 1, wherein the main body of the sealing cap has an outer diameter, and wherein the sealing cap further includes a flange situated at the upper end thereof and extending radially outwardly therefrom, the flange having an outer diameter, the outer diameter of the flange being greater than the outer diameter of the main body of the sealing cap, the flange being in close proximity to the upper surface of the lid when the sealing cap is threadingly received by the tubular member of the container.

5. A resealable fluid container as defined by claim 4, which further comprises a sealing member, the sealing member being disposed on the main body of the sealing cap and being situated between the flange and the upper surface of the lid of the container when the sealing cap is threadingly received by the bore of the tubular member.

6. A resealable fluid container as defined by claim 1, wherein the inner surface of the tubular member includes one of a protrusion and a detent situated thereon, and the main body of the sealing cap includes the other of a protrusion and a detent situated thereon, the protrusion being receivable by the detent when the sealing cap is threadingly received by the bore of the tubular member.

* * * * *